US010910148B2

(12) United States Patent
Kim et al.

(10) Patent No.: US 10,910,148 B2
(45) Date of Patent: Feb. 2, 2021

(54) TRANSFORMER HAVING NOISE REDUCING MEANS

(71) Applicant: HYOSUNG HEAVY INDUSTRIES CORPORATION, Seoul (KR)

(72) Inventors: Do Jin Kim, Changwon-si (KR); Chui Jun Park, Busan (KR); Kyo Ho Lee, Gimhae-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 285 days.

(21) Appl. No.: 16/067,437

(22) PCT Filed: Dec. 21, 2016

(86) PCT No.: PCT/KR2016/015064
§ 371 (c)(1),
(2) Date: Jun. 29, 2018

(87) PCT Pub. No.: WO2017/116068
PCT Pub. Date: Jul. 6, 2017

(65) Prior Publication Data

US 2019/0006093 A1 Jan. 3, 2019

(30) Foreign Application Priority Data

Dec. 30, 2015 (KR) ..... 10-2015-0190332

(51) Int. Cl.
*H01F 27/33* (2006.01)
*H01F 27/245* (2006.01)
*H01F 27/26* (2006.01)

(52) U.S. Cl.
CPC ..... *H01F 27/33* (2013.01); *H01F 27/245* (2013.01); *H01F 27/26* (2013.01); *H01F 27/263* (2013.01)

(58) Field of Classification Search
CPC ..... H01F 27/33; H01F 27/245; H01F 27/26; H01F 27/263; H01F 27/2455
(Continued)

(56) References Cited

U.S. PATENT DOCUMENTS 3,270,308 A * 8/1966 Mittermaier ..... H01F 27/2455 336/217
3,370,350 A * 2/1968 Logan ..... H01F 41/024 29/606
(Continued)

FOREIGN PATENT DOCUMENTS

JP 53032326 A * 3/1978
JP 02-095221 U 7/1990
(Continued)

*Primary Examiner* — Tszfung J Chan
(74) *Attorney, Agent, or Firm* — Novick, Kim & Lee, PLLC; Jae Youn Kim

(57) ABSTRACT

Provided is a transformer having a noise reducing means. The transformer includes: an iron core (P), which is formed by stacking a plurality of steel sheets, and has stepped parts (S) formed at a portion thereof with different widths; and the noise reducing means provided at the stepped parts (S) so as to increase coupling force among the plurality of steel sheets. The noise reducing means includes: pressing bars (30) mounted on the stepped parts (S) of the iron core (P), and having plane-shaped horizontal pressing surfaces (31) in the direction in which the steel sheets are stacked; and a binding (90) for surrounding the outer surface of the iron core (P) including the pressing bars (30), so as to press the pressing bars (30) in the stacking direction of the steel sheets.

5 Claims, 6 Drawing Sheets

(58) Field of Classification Search
USPC ..... 336/5, 210, 216, 217, 233, 234
See application file for complete search history.

(56) References Cited

U.S. PATENT DOCUMENTS

| | | | | | |
|---|---|---|---|---|---|
| 3,568,118 | A | * | 3/1971 | Kuriyama | H01F 27/303<br>336/60 |
| 3,783,426 | A | * | 1/1974 | Morris, Jr. | H01F 27/263<br>336/196 |

FOREIGN PATENT DOCUMENTS

| | | | | |
|---|---|---|---|---|
| JP | 11-111529 | A | | 4/1999 |
| JP | 11111529 | A | * | 4/1999 |
| KR | 11-144989 | A | | 5/1999 |
| KR | 20-0291151 | Y1 | | 10/2002 |
| KR | 10-2012-0129148 | A | | 11/2012 |

* cited by examiner

TRANSFORMER HAVING NOISE REDUCING MEANS

TECHNICAL FIELD

The present invention relates to a transformer and, more particularly, to a transformer that includes a noise reducing means within the stacked structure of the iron core of the transformer to reduce vibration and noise.

BACKGROUND ART

A transformer serves to raise or lower electric pressure and is an important element of an electrical power system. The role of the transformer is of great importance in providing a stable supply of power. The transformer includes wires connected both on the inside and the outside for transmitting high-voltage power.

The transformer may include a core body and coils that surround the core body. More specifically, the core body is composed of a yoke and a plurality of legs that extend downward from the yoke, with coils wound around the perimeters of the legs. The yoke and legs are formed by stacking a plurality of steel sheets.

That is, an iron core of the transformer is formed by stacking thin silicon steel sheets, etc., and air gaps formed in-between the steel sheets due to manufacturing tolerances are a cause of noise and vibration, the reduction of which is a very important issue. For this, various techniques for increasing the adhesion forces between the steel sheets are being developed, and one such technique increases the bracing forces within the iron core by way of binding.

Korean Registered Utility Model No. 20-0291151 discloses a technique that uses binding to increase the coupling forces between steel sheets, whereby round bars are installed at the recessed edge portions of the steps formed by the plurality of steel sheets, so as to reduce tolerances occurring at the recessed edge portions and increase the adhesion force.

However, according to such prior art, the round bars transfer stresses not only in the stacking direction of the steel sheets but also in a perpendicular direction (normal direction), lowering the overall adhesion force. In certain cases, the round bars may even separate the steel sheets from one another at the recessed edge portions of each step.

DISCLOSURE

Technical Problem

The present invention has been made keeping in mind the above problems occurring in the prior art, and an objective of the present invention is to reduce the vibration and noise of a transformer by using a noise reduction means that concentrates the fastening forces in the stacking direction of an iron core included in the transformer.

Technical Solution

An embodiment of the present invention conceived to achieve the objective above includes: an iron core, which is formed by stacking a plurality of steel sheets, and in a portion of which stepped parts are formed with different widths, and a noise reducing means provided at the stepped parts to increase the fastening forces of the plurality of steel sheets, wherein the noise reducing means includes a pressing bar, which is placed at a stepped part of the iron core and which has a horizontal pressing surface shaped as a flat plane in a stacking direction of the steel sheets, and a binding, which surrounds the outer surface of the iron core including the pressing bar to press the pressing bar in the stacking direction of the steel sheets.

The pressing bar includes: a horizontal pressing surface corresponding to a horizontal surface of the stepped part and configured to press the steel sheet in the stacking direction, a vertical pressing surface corresponding to a vertical surface of the stepped part and configured to press a side portion of a stacked steel sheet, and a non-pressing surface configured to tightly contact the binding without touching the horizontal surface or the vertical surface of the stepped part.

The pressing bar has a cross section shaped as a circular sector such that the non-pressing surface is shaped as a curved plane.

If the horizontal surface and the vertical surface of the stepped part are of an equal length, then the length of the horizontal surface of the stepped part is the radius for a sector shape forming a cross section of the pressing bar, and if the horizontal surface and the vertical surface of the stepped part are of unequal lengths, then a length tantamount to 1.02~1.05 times the length of the diagonal line traversing from one end of the horizontal surface to one end of the vertical surface is the length of the arc of a sector shape forming a cross section of the pressing bar.

A portion of an outer surface of the pressing bar is formed as a horizontal pressing surface having the shape of a flat plane in a stacking direction of the steel sheets, and a remaining portion is formed as a non-pressing surface that tightly contacts the binding but does not touch the iron core.

The non-pressing surface of the pressing bar is formed such that the non-pressing surface is increasingly farther away from the side surface of the stepped part at increasingly higher positions from the horizontal pressing surface.

The pressing bar has a cross section shaped as a semicircle such that the horizontal pressing surface is shaped as a flat plane and the non-pressing surface is shaped as a curved plane.

A non-pressing surface that is formed not to touch the horizontal surface or a vertical surface of the stepped part, from among an outer surface of the pressing bar, is provided to protrude beyond the path along which the binding is braced, so that the binding presses the non-pressing surface when the binding is coupled to the iron core.

An epoxy resin is coated on a vertical surface of the stepped part to form an adhesion layer.

Advantageous Effects

A transformer having a noise reducing means according to the present invention as described above can provide the following effects.

According to the present invention, a pressing surface having the form of a flat plate along the stacking direction of the iron core is formed in the pressing bar, so that the iron core is pressed in a stable manner over a large area. Therefore, the clamping forces for the steel sheets forming the iron core are increased, and air gaps are reduced, so that vibrations in the iron core as well as noise caused by the vibrations are reduced.

Furthermore, according to the present invention, the pressing bar of the noise reducing means is also provided with a vertical pressing surface that has the form of a flat plane along the side surface direction of the stepped part, i.e. the normal direction, in addition to the stacking direction of the iron core, so that the pressing bar may press the overall outer surface of the stepped part in a stable manner and thus increase the completeness quality of the iron core assembly.

In particular, an adhesion layer made of an epoxy resin is formed on a side surface of the stepped part of the iron core, and as the vertical pressing surface of the pressing bar presses on the adhesion layer in a stable manner, the iron core may be coupled stably in both the stacking direction and the perpendicular direction. This may increase the coupling forces, and ultimately, the noise reducing means can compensate for possible design tolerances.

MODE FOR INVENTION

Figure 1:
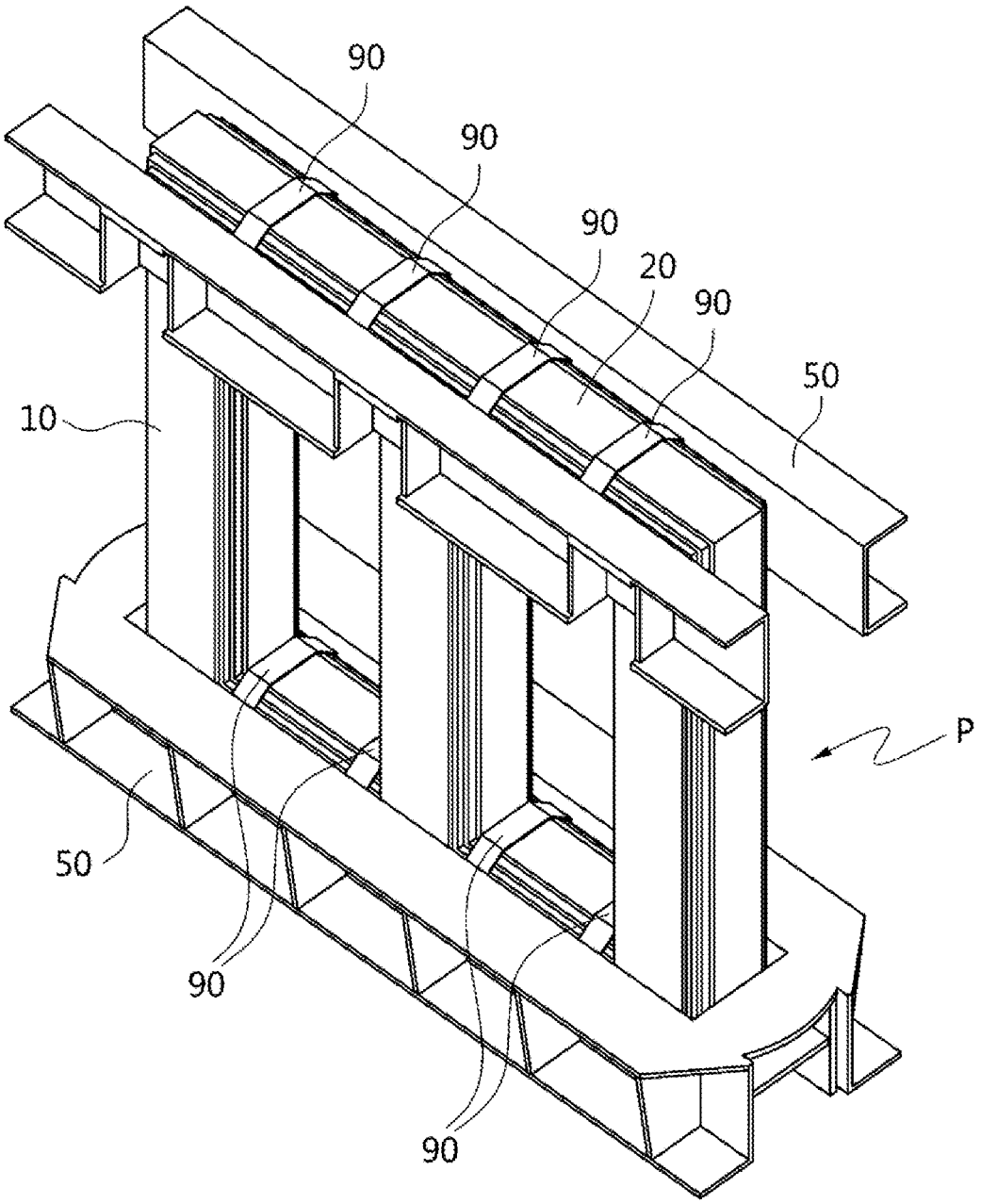
FIG. 1 is a perspective view of the overall structure of an embodiment of a transformer having a noise reducing means based on the present invention.

A detailed description of certain embodiments of the present invention will be provided below with reference to illustrative drawings. It should be noted that, in assigning reference numerals to the elements in the drawings, the same numerals have been applied as much as possible for the same elements, even when shown in different figures. Also, in describing the embodiments of the present invention, detailed descriptions of known elements or functions are omitted, if it is deemed that such specific descriptions may hinder the understanding of the embodiments of the present invention.

The description of certain elements for the embodiments of the present invention may use terms such as first, second, A, B, (a), (b), etc. These terms are intended solely to differentiate one element from another and do not limit the property, order, sequence, etc., of the corresponding element. If an element is described as being "connected", "coupled", or "joined" to another element, it should be understood that, while the element may be directly connected or joined with the other element, one or more other elements may also be "connected", "coupled", or "joined" between the elements.

FIG. 1 illustrates the overall structure of a transformer having a noise reduction means according to the present invention. The main components of the transformer are enclosed within the main body (not shown) of the transformer. For the sake of convenience, the present specification describes only the main components.

The main skeleton of a transformer based on the present invention is formed of an iron core P, where the iron core P in turn includes legs 10 and yokes 20. Also, although this is not shown in the drawings, coils may be wound around the iron core P. As illustrated in FIG. 1, the legs 10 extend along the up/down direction and several legs 10 are arranged in constant intervals. Although this is not shown in the drawings, coils may be wound around the legs 10.

Yokes 20 are provided at the upper and lower ends of the legs 10. The yokes 20 may traverse a plurality of legs 10, and it is possible to have a yoke 20 provided only at the upper ends or at the lower ends of the legs 10. The two yokes 20 have the same structure.

Figure 2:
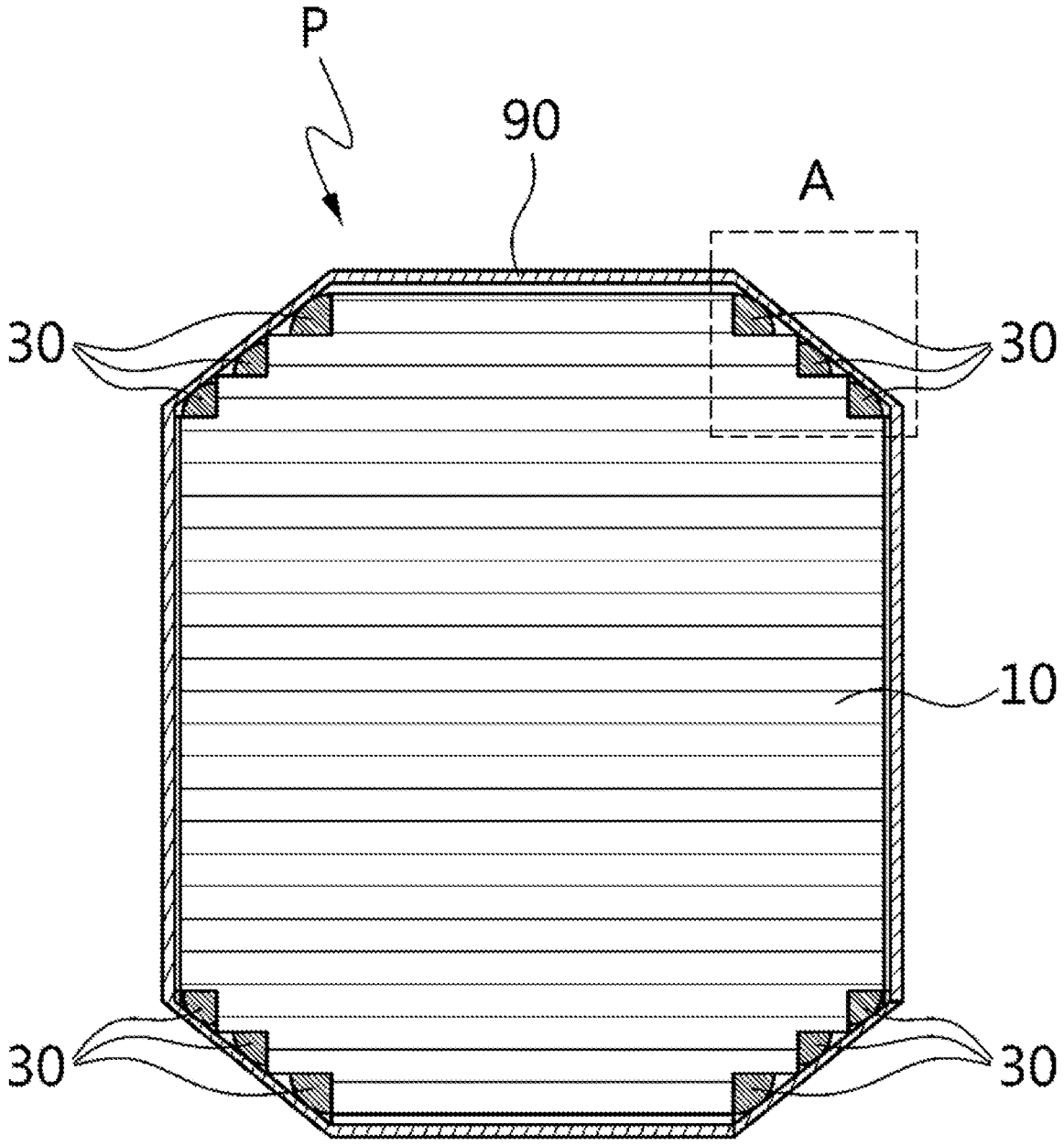
FIG. 2 is a cross-sectional view illustrating the structure of an iron core to which a first embodiment of a noise reducing means based on the present invention has been applied.

Also, it is possible to form the legs 10 and yokes 20 by stacking a plurality of steel sheets and afterwards assembling the stacked sheets in an intersecting manner into the legs 10 and yokes 20, or by stacking a plurality of steel sheets to form a single core that includes the legs 10 and yokes 20 as an integrated body. That is, the legs 10 and yokes 20 are formed by stacking a plurality of steel sheets, but a great variety of embodiments are conceivable in regard to their structure. As illustrated in FIG. 2, a yoke 20 is made of a multiple number of steel sheets such that the shapes of stepped parts S are formed on the outer surface.

The outer surfaces of the yokes 20 are surrounded by frames 50. The frames 50 are provided to surround the outer surfaces of the yokes 20 on both sides, and as seen in FIG. 1, the frames 50 may be provided in the same manner to the lower yoke 20 also. As illustrated in the drawing, the frames 50 extend elongated along both sides of the yoke 20 such that the yoke 20 is positioned in-between.

Here, the legs 10 and yokes 20 forming the iron core P are all formed by stacking a plurality of steel sheets. That is, a plurality of thin flat steel sheets are stacked together to form the legs 10 and yokes 20 and thus form a single transformer core. Here, the steel sheets may be thin silicon steel sheets.

In the legs 10 and yokes 20 forming the iron core P, stepped parts S are formed. The stepped parts S are formed because the plurality of steel sheets protrude to different extents at the corners of the stacked iron core P and may be formed in both legs 10 and yokes 20. The stepped parts S are vulnerable portions in terms of the coupling forces in the iron core P. This is because when the stacked steel sheets are surrounded and secured with bindings 90, it is difficult to correctly wind the bindings 90 around the stepped parts S and achieve tight contact, and also because there may be design tolerances. This may lead to vibration and noise caused by the vibration, but the present invention employs a noise reducing means, described below in more detail, to resolve this problem.

The noise reducing means includes bindings 90, which surround the iron core P to increase the fastening forces, and pressing bars 30 that are inserted at the stepped parts S of the iron core P. The bindings 90 and pressing bars 30 cooperate to add fastening forces in the direction in which the steel sheets forming the iron core P are stacked, and the specific structures of the bindings 90 and pressing bars 30 are described separately in the following.

Figure 3:
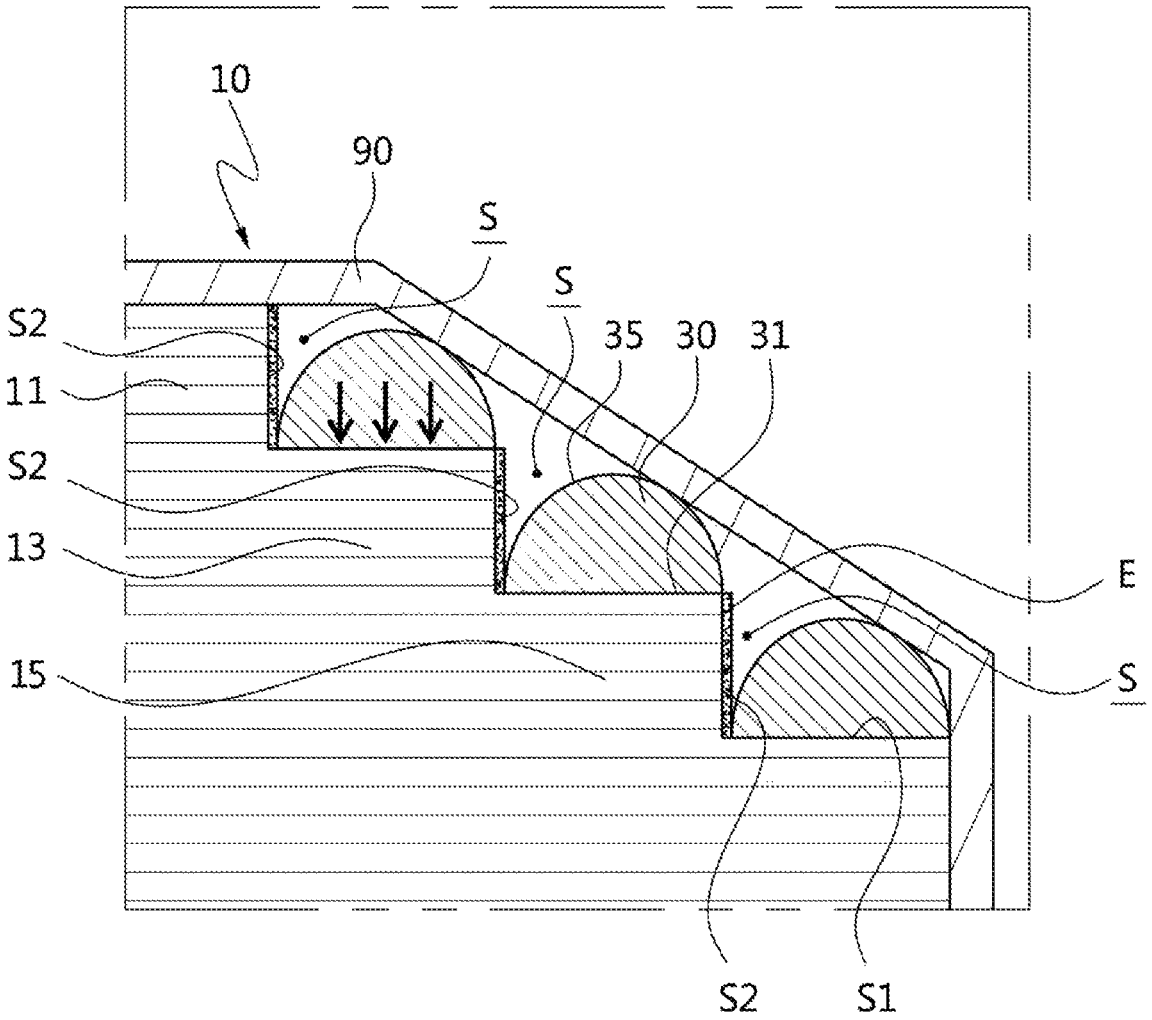
FIG. 3 is a magnified view of part A in FIG. 2.

As illustrated in FIG. 2, the bindings 90 surround the iron core P, and the pressing bars 30 are arranged at the stepped parts S formed in the corner. The detailed shapes of the stepped part S and pressing bars 30 are illustrated in FIG. 3. The pressing bars 30 in FIG. 3 represent a first embodiment where the pressing bars 30 have cross sections roughly shaped as a semicircle. The pressing bars 30 have thin, elongated structures that are formed along the lengthwise direction of the iron core P. In this embodiment, the pressing bars 30 are made of compressed wood, but various other materials may also be used.

Describing first the stepped part S for reference, a stepped part S includes a horizontal surface S, formed in the direction in which the steel sheets forming the iron core P are stacked, and a vertical surface S2, formed perpendicularly as a side surface of the iron core P, as illustrated in FIG. 3. In the following descriptions, mentions of a horizontal surface S1 and of a vertical surface S2 refer to the horizontal surface S1 and the vertical surface S2 of a stepped part S.

The pressing bar 30 fills up the space of the stepped part S, so that when the iron core P is wound by the binding 90, the binding 90 may push the stepped part S for tight contact in the direction of the iron core P. For this, the pressing bar 30 has a horizontal pressing surface 31 that is placed on the stepped part S of the iron core P and has the shape of a flat plane in the direction in which the steel sheets are stacked. The horizontal pressing surface 31, which is the portion facing the horizontal surface S1 of the stepped part S, has the shape of a flat plane to be capable of strongly pressing the steel sheet downwards, i.e. in the direction in which the steel sheets are stacked, as represented by the arrows in FIG. 3.

More precisely put, a portion of the outer surface of the pressing bar 30 is formed as a horizontal pressing surface 31, which is shaped as a flat plane in the direction in which the steel sheets are stacked, while the remaining portion is formed as a non-pressing surface 35, which is in tight contact with the binding 90 but not in contact with the iron core P. The non-pressing surface, though not in contact with the stepped part S of the iron core P, is placed in linear contact or planar contact with the binding 90, so that the entire pressing bar 30 may be pushed in the direction of the stepped part S.

As the pressing bar 30 has a semicircular cross section, the non-pressing surface 35 of the pressing bar 30 is increasingly farther away from the side surface of the stepped part S at parts that are increasingly higher from the pressing surface. Also, the force with which the pressing bar is pressed by the binding 90 is concentrated solely in the horizontal direction, i.e. the direction in which the steel sheets are stacked, so that the coupling forces for the steel sheets may be increased, and air gaps may be reduced. Incidentally, the reference numerals 11, 13, and 15 represent different layers of the iron core P formed as the different heights of the iron core P form levels.

Figure 4:
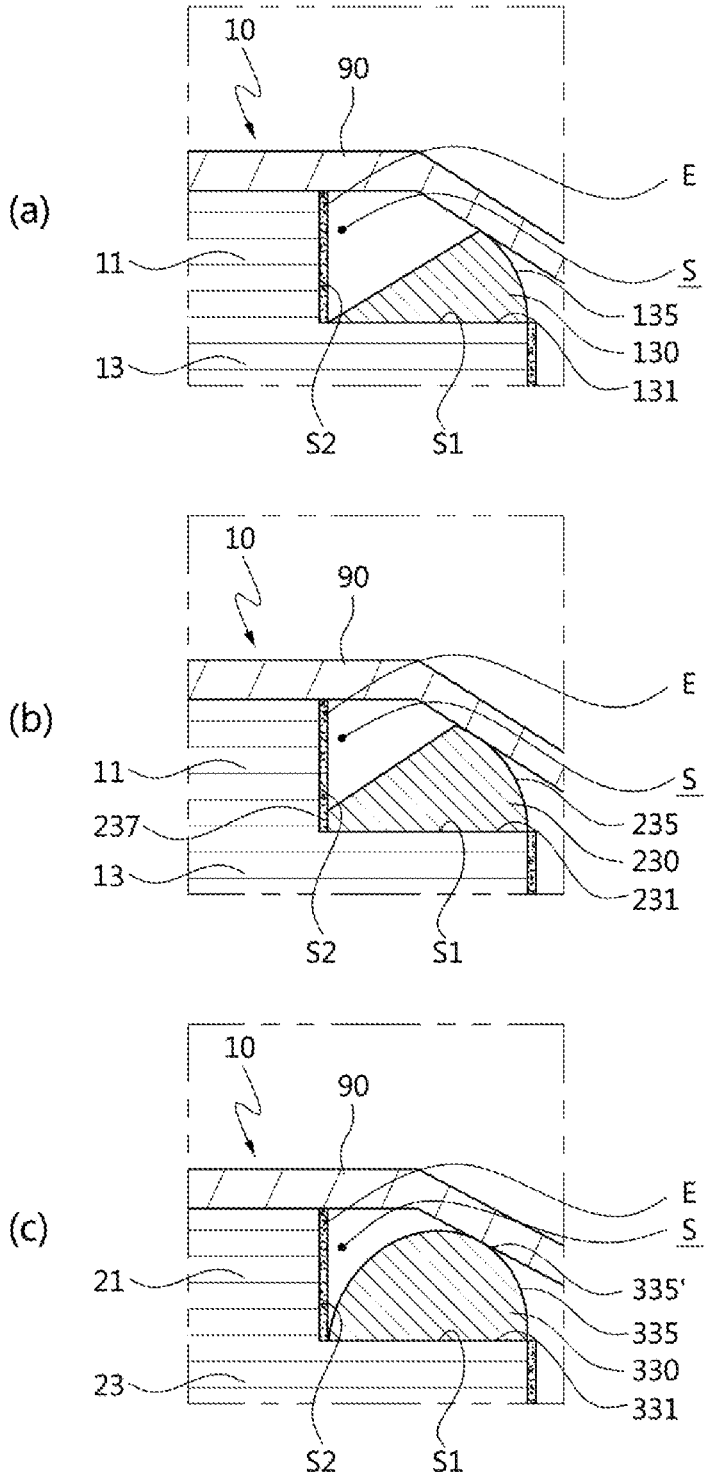
FIG. 4 shows cross-sectional views illustrating essential parts of iron cores to which a second to a fourth embodiment of a noise reducing means based on the present invention have been applied.

FIG. 4 illustrates other embodiments of the pressing bars. FIG. 4(*a*) illustrates a second embodiment in which the pressing bars 130 have a sector-shaped cross section. In this case also, the pressing bar 130 is structured such that a horizontal pressing surface 131 is formed and a non-pressing surface 135 protrudes outwards from the stepped part S to be pressed by the binding 90.

In the third embodiment shown in FIG. 4(*b*), the pressing bar 230 has a cross section similar to a sector shape, but in addition to the horizontal pressing surface 231, also includes a vertical pressing surface 237 of a particular height. The vertical pressing surface 237 is the portion that touches the vertical surface S2 of the stepped part S and presses the vertical surface S2. Thus, the force by which the non-pressing surface 235 is pressed by the binding 90 is transferred to the horizontal pressing surface 31 as well as the vertical pressing surface 237, thereby pressing the vertical surface S2 of the stepped part S to a certain degree.

In the fourth embodiment shown in FIG. 4(*c*), the pressing bar 330 has a cross section of a semicircular form, but protruding more to one side instead of maintaining an exact semicircular form. To be more precise, from among the outer surface of the pressing bar 330, a portion 335' of the non-pressing surface 335, which is not in contact with either the horizontal surface S1 or the vertical surface S2, protrudes beyond the path through which the binding 90 is braced, so that when the binding 90 is coupled with the iron core P, the binding 90 presses against the non-pressing surface 335. That is, in the pressing bar 330 illustrated in FIG. 4(*c*), the cross section does not have a consistent radius of curvature. This structure allows the non-pressing surface 335 to be more strongly pressed by the binding 90.

Figure 5:
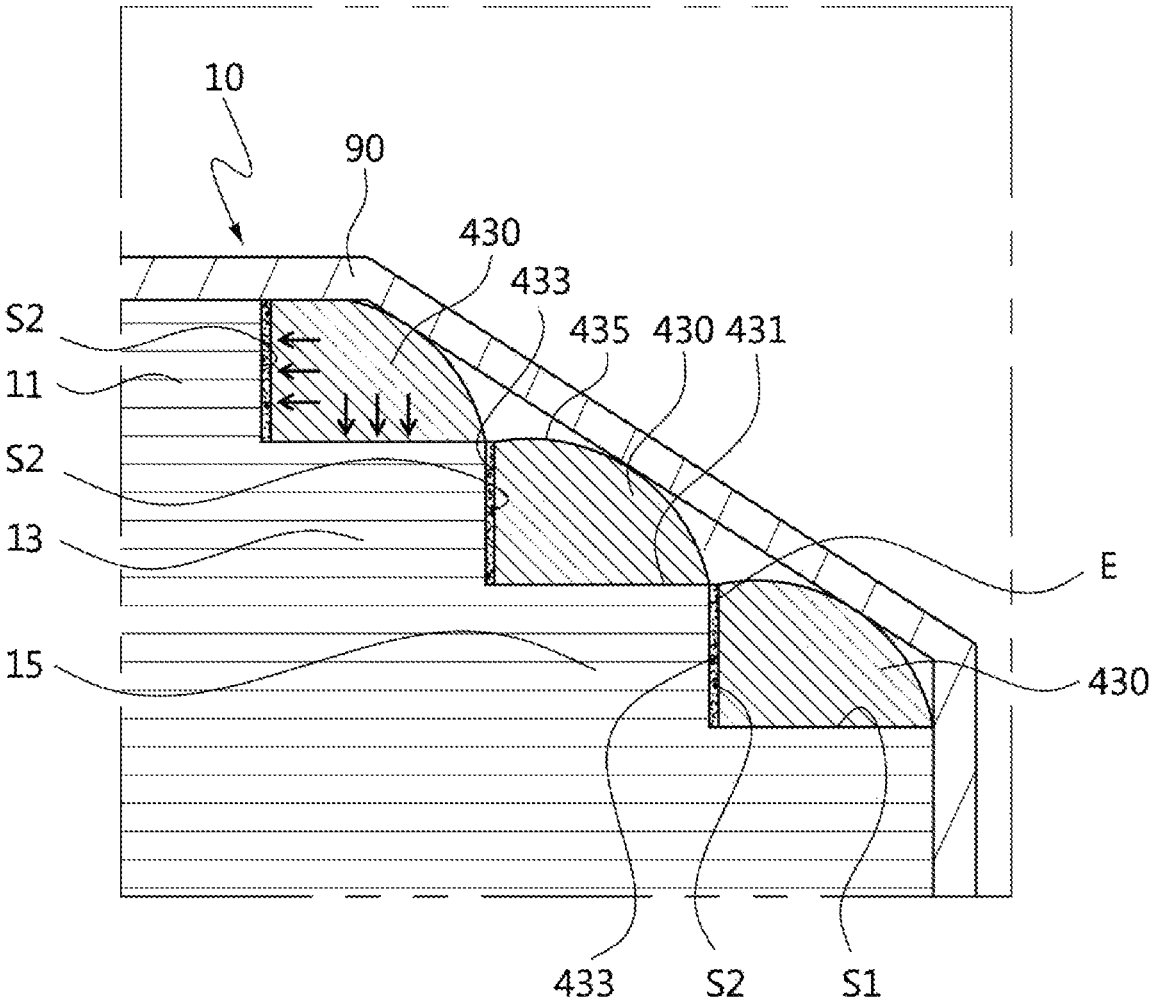
FIG. 5 is a cross-sectional view illustrating the structure of an iron core to which a fifth embodiment of a noise reducing means based on the present invention has been applied.

FIG. 5 illustrates the structure of an iron core P to which a fifth embodiment of the noise reducing means has been applied. As shown in the drawing, the cross section of a pressing bar 430 forming the noise reducing means can have a shape of roughly ¼ of a circle. Accordingly, the pressing bar 430 presses not only the horizontal surface S1 but also the vertical surface S2 of the stepped part S.

More specifically, the pressing bar 430 includes a horizontal pressing surface 431, which corresponds to the horizontal surface S1 of the stepped part S and presses the steel sheets in the stacking direction, and a vertical pressing surface 433, which corresponds to the vertical surface S2 of the stepped part S and presses the side surface parts of the stacked steel sheets. The horizontal pressing surface 431 and the vertical pressing surface 433 are formed in widths corresponding to those of the horizontal surface S1 and vertical surface S2 of the stepped part S, respectively, to push the horizontal surface S1 and the vertical surface S2 in a stable manner.

The remaining portion of the pressing bar 430 is formed as a non-pressing surface 435, placed in tight contact with the binding 90 without touching the horizontal surface S1 or vertical surface S2 of the stepped part S. The non-pressing surface 435 may be in linear contact or planar contact with the binding 90, so that the pressing bar 430 may push strongly in the direction of the horizontal surface S1 and in the direction of the vertical surface S2 simultaneously.

The stepped part S may not necessarily have the same length for the horizontal surface S1 and the vertical surface S2, and either one of the horizontal surface S1 and the vertical surface S2 may be formed longer depending on the design. In such cases, the shape of the pressing bar 430 may be determined as follows.

When the lengths of the horizontal surface S1 and the vertical surface S2 in the stepped part S are different, it is preferable that the length of the arc of the sector-shaped cross section of the pressing bar 430 be 1.02~1.05 times the length l1 of the diagonal line that connects one end of the horizontal surface S1 and one end of the vertical surface S2. This is because the length of the arc of the sector shape formed by the cross section of the pressing bar 430 has to be greater than the length l1 of the diagonal line in order for the cross section to be protruding relatively and be pressed by the binding 90, and the pressing bar 430 may be pressed in the most stable manner when the length of the arc is about 1.02~1.05 times the length l1 of the diagonal line.

Figure 6:
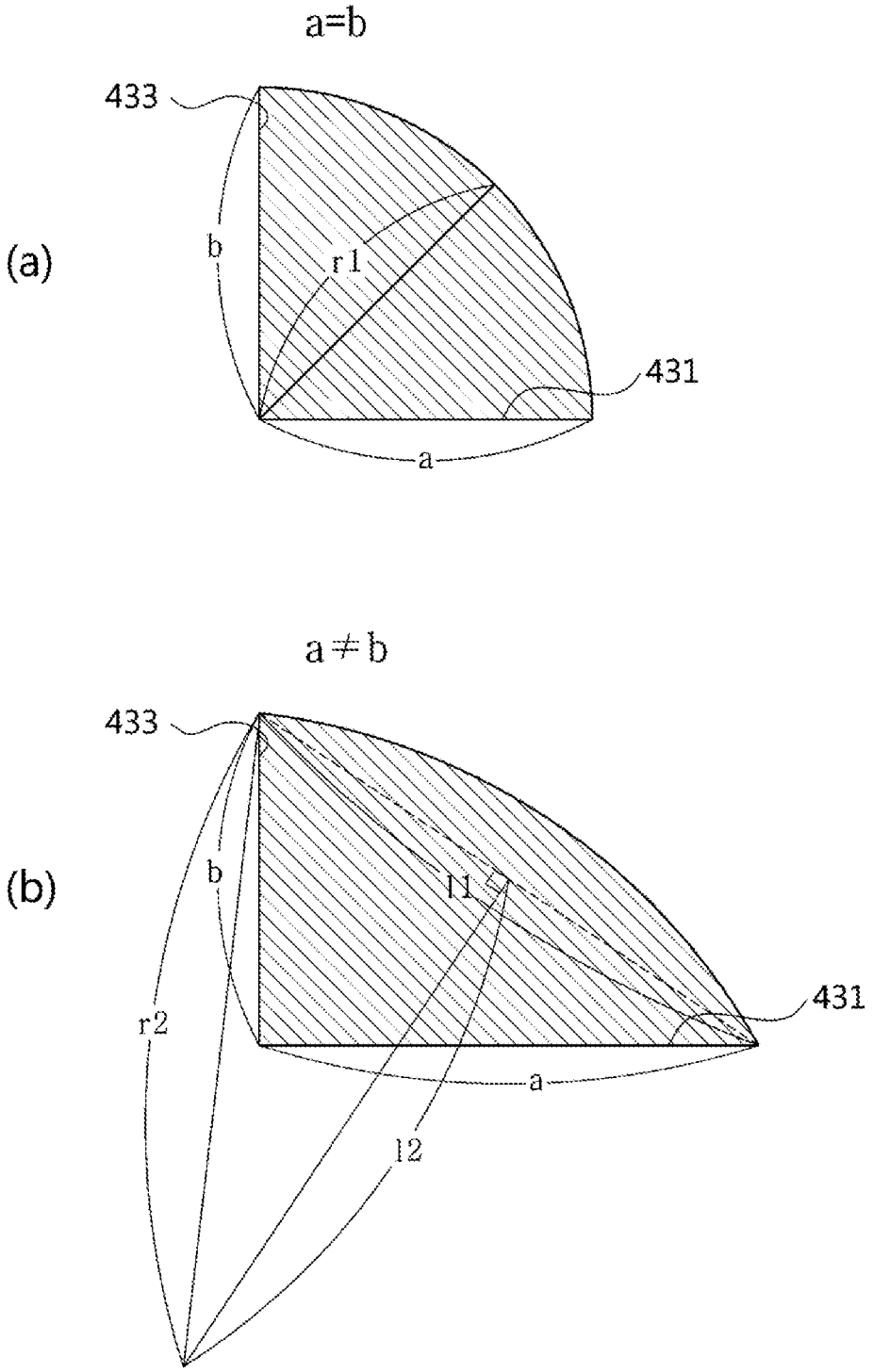
FIG. 6 shows conceptual diagrams illustrating ways for calculating the form of the pressing bar according to the shape of the stepped part of the iron core when a fifth embodiment of a noise reducing means based on the present invention is applied.

FIG. 6 conceptually illustrates the shapes that the cross section of the pressing bar 430 may assume depending on the form of the stepped part S. As illustrated in FIG. 6(*a*), when the horizontal surface S1 and the vertical surface S2 are of equal length, the cross section of the pressing bar 430 is in the form of a sector having a central angle of 90°.

When the horizontal surface S1 and the vertical surface S2 of the stepped part S have unequal lengths, the cross section becomes the form shown in FIG. 6(*b*). Specifically, the length of the arc of the sector formed by the cross section of the pressing bar 430 is 1.02~1.05 times the length of a diagonal line connecting one end of the horizontal surface S1 and one end of the vertical surface S2, and when the length is 1.02 times as great, the length from the center of the sector to the diagonal line is l2, and the radius of the sector is r2. Here, the exact values for r2 and l2 may be obtained since the length of the diagonal line (l1) and the length of the arc (1.02 times l1) are fixed.

On the vertical surface S2 of the stepped part S, i.e. the flat surface formed by the side surfaces of the stacked steel sheets, an adhesion layer E is formed. The adhesion layer E is formed by an adhesive such as epoxy resin and serves to increase the overall fastening forces of the steel sheets by reinforcing the side surface parts of the steel sheets. Also, the adhesion layer E may fill up any step differences between the side surfaces of the steel sheets caused by design tolerances or manufacturing tolerances.

In particular, in the fifth embodiment illustrated in FIG. 5, the vertical pressing surface 433 of the pressing bar 430 may strongly press the adhesion layer E, so that the adhesion layer E may reinforce the fastening forces in the iron core P more effectively.

The bindings 90 tightly surround the outer surface of the iron core P, in which a plurality of steel sheets are stacked together, in order to reduce the air gaps in-between the steel sheets. In this way, the vibration or heat emission caused by air gaps between the steel sheets are reduced.

Here, the bindings 90 are coupled at positions adjacent to where the yoke 20 and the legs 10 are coupled together, preferably at positions corresponding to the edges of the coupling parts. Thus, the bindings 90 can be made to not only secure the steel sheets forming the yoke 20 but also increase the fastening forces between the yoke 20 and the legs 10. Of course, winding the bindings 90 at the corresponding coupling parts to directly press the portions where the yoke 20 and the legs 10 intersect may increase the fastening forces even further, but it would be difficult to bind the coupling parts directly because of the interference by the legs 10. A variety of materials may be adopted as the material for the bindings 90, including fibers, synthetic resin, silicone, metal, etc.

The following is a description of the procedure by which an iron core is pressed by the noise reducing means according to the present invention.

In-between the steel sheets, there are air gaps present, due to tolerances. The air gaps in-between steel sheets increase or saturate the magnetic flux density and increase and increase the vibration, noise, and heat emission of the transformer during operation. Thus, the worker has to control any such increase in noise during the operation of the transformer.

To this end, the noise reducing means may be used, where the noise reducing means includes clamping bars and bindings 90 to fill up the spaces at the stepped parts S of the iron core P and surround and secure the iron core P, so as to strongly compress the outer surface of the iron core P.

With reference to the embodiment shown in FIG. 5, when the bindings 90 are applied with the pressing bars 430 placed in the stepped parts S, the horizontal pressing surfaces 431 and the vertical pressing surfaces 433 of the pressing bar 30 are placed in tight contact with and pressed against the horizontal surfaces S1 and vertical surfaces S2, respectively, of the stepped parts S. Accordingly, the forces applied on the horizontal surfaces S Ipush the steel sheets in even tighter contact and increase the fastening forces, and the forces applied on the vertical surfaces S2 press the adhesion layers E and increase the fastening forces at the side surface parts of the steel sheets.

Thus, the fastening forces are improved overall at the stepped parts S, preventing any decrease in the fastening forces of the overall iron core P otherwise caused by the presence of the stepped parts S, and instead increasing the quality of assembly of the whole iron core P.

In the foregoing, even though the elements included in an embodiment of the present invention are described as being coupled into an integrated form or as operating in a coupled manner, the present invention is not limited to such embodiment. The elements may just as well be coupled into one or more forms for operation as long as the resulting arrangements do not depart from the purpose of the present invention. Also, terms such as "including", "forming", or "having" as used in the above merely mean that the associated element is present therein and do not preclude the presence of other elements. Such a description must therefore be interpreted as meaning that other elements may additionally be included, unless there is a specific statement to the contrary. All terms used herein including technical terms and scientific terms, unless defined otherwise, have the same meanings as those understood by the person having ordinary skill in the field of art to which the present invention pertains. Commonly used terms, such as terms defined in the dictionary, should be interpreted in accordance with the context of the relevant technology should not be interpreted as having ideal or excessively formal meanings, unless clearly defined for the present invention.

The descriptions above are merely illustrative of the technical spirit of the present invention, and the person having ordinary skill in the field of art to which the present invention pertains would be able to derive various modifications and alterations without departing from the fundamental essence of the present invention. Thus, the embodiments of the present invention are disclosed, not to limit, but to explain the spirit of the present invention, and the scope of the technical sprit the present invention is not to be limited by the embodiments. The scope of protection of the present invention is to be interpreted from the scope of claims below, and all technical concepts within the scope of equivalency are to be regarded as being encompassed by the scope of rights of the present invention.

The invention claimed is:

1. A transformer having a noise reducing means, the transformer comprising:

an iron core including a plurality of steel sheets, the iron core having stepped parts formed in a portion thereof with different widths, wherein the noise reducing means is provided at the stepped parts to increase fastening forces of the plurality of steel sheets, wherein the noise reducing means comprises:

a pressing bar placed at a stepped part of the iron core and having a horizontal pressing surface shaped as a flat plane in a stacking direction of the steel sheets, and a binding surrounding an outer surface of the iron core including the pressing bar to press the pressing bar in the stacking direction of the steel sheets, and wherein a portion of an outer surface of the pressing bar is formed as the horizontal pressing surface having a shape of the flat plane in the stacking direction of the steel sheets, and a remaining portion is formed as a curved non-pressing surface configured to tightly contact the binding without touching the iron core.

2. The transformer having the noise reducing means according to claim 1, wherein the curved non-pressing surface of the pressing bar is formed such that the curved non-pressing surface is increasingly farther away from a side surface of the stepped part at increasingly higher positions from the horizontal pressing surface.

3. The transformer having the noise reducing means according to claim 2, wherein the pressing bar has a cross section shaped as a semicircle such that the horizontal pressing surface is shaped as the flat plane.

4. The transformer having the noise reducing means according to claim 1, wherein the curved non-pressing surface formed not to touch a horizontal surface or a vertical surface of the stepped part from among an outer surface of the pressing bar is provided to protrude beyond a path along which the binding is braced, so that the binding presses the non-pressing surface when the binding is coupled to the iron core.

5. The transformer having the noise reducing means according to claim 4, wherein an epoxy resin is coated on a vertical surface of the stepped part to form an adhesion layer.

* * * * *